US007621166B2

(12) United States Patent
Ferreira et al.

(10) Patent No.: US 7,621,166 B2
(45) Date of Patent: Nov. 24, 2009

(54) DIE COMPONENTS FOR MAKING PRESSURE RELIEF DEVICES

(75) Inventors: Mark A. Ferreira, Decatur, AL (US); Yurij F. Wowczuk, Pittsburgh, PA (US); Richard A. Henry, Decatur, AL (US); Richard H. Raborn, Brandon, MS (US)

(73) Assignee: Illinois Tool Works Inc., Glenview, IL (US)

( * ) Notice: Subject to any disclaimer, the term of this patent is extended or adjusted under 35 U.S.C. 154(b) by 418 days.

(21) Appl. No.: 11/732,536

(22) Filed: Apr. 4, 2007

(65) Prior Publication Data

US 2007/0175259 A1 Aug. 2, 2007

Related U.S. Application Data

(62) Division of application No. 10/924,486, filed on Aug. 24, 2004, now Pat. No. 7,222,757.

(51) Int. Cl.
*B21D 22/00* (2006.01)

(52) U.S. Cl. ..... 72/347; 72/715

(58) Field of Classification Search ..... 72/57, 72/347, 348, 349, 379.4, 412, 413, 470, 473, 72/715; 413/56, 67, 68
See application file for complete search history.

(56) References Cited

U.S. PATENT DOCUMENTS

| | | | | |
|---|---|---|---|---|
| 2,795,350 | A | 6/1957 | Lapin | |
| 2,951,614 | A | 6/1960 | Greene | |
| 3,219,488 | A | 11/1965 | Southworth, Jr. | |
| 3,484,817 | A | 12/1969 | Wood | |
| 3,680,743 | A | 8/1972 | Reinnagel | |
| 3,724,727 | A | 4/1973 | Zundel | |
| 3,759,414 | A | 9/1973 | Beard | |
| 3,786,967 | A | 1/1974 | Giocomo et al. | |
| 3,826,412 | A | 7/1974 | Kneusel | |
| 3,831,822 | A | 8/1974 | Zundel | |
| 3,938,693 | A | 2/1976 | Patel et al. | |
| 3,979,009 | A | 9/1976 | Walker | |
| 3,998,174 | A | 12/1976 | Saunders | |
| 4,003,505 | A | 1/1977 | Hardt | |
| 4,109,599 | A * | 8/1978 | Schultz | 413/8 |
| 4,347,942 | A | 9/1982 | Jernberg et al. | |
| 4,416,388 | A | 11/1983 | Mulawski | |
| 4,424,698 | A * | 1/1984 | Langseder | 72/397 |
| 4,433,791 | A | 2/1984 | Mulawski | |

(Continued)

*Primary Examiner*—Edward Tolan
(74) *Attorney, Agent, or Firm*—Buchanan Ingersoll & Rooney PC

(57) ABSTRACT

A pressure relief device for venting an internally pressurized container such as an aerosol can has three sections, a concave annular outer area, a circular central area and an annular intermediate area connecting the concave annular area to the circular area. The three sections all have the same thickness. The central area has a center point and an arc shaped score line extending through 132° to 138°, preferably 135°, about an arc center. The arc center is offset from the center point of the circular area by a distance of from about 0.290 inches. The score line has a depth of from 0.010 to 0.012 inches and is trapezoidal in transverse cross section. The intermediate area meets the circular area at an angle greater than 90° and the intermediate area meets the concave annular outer area at an angle greater than 90°.

5 Claims, 3 Drawing Sheets

U.S. PATENT DOCUMENTS

| | | | | |
|---|---|---|---|---|
| 4,436,218 | A | | 3/1984 | Beese |
| 4,513,874 | A | | 4/1985 | Mulawski |
| 4,576,303 | A | | 3/1986 | Mundt et al. |
| 4,580,690 | A | | 4/1986 | Mulawski |
| 4,588,101 | A | | 5/1986 | Ruegg |
| 4,610,370 | A | | 9/1986 | Patterson et al. |
| 4,738,372 | A | | 4/1988 | Jernberg |
| 4,842,965 | A | | 6/1989 | Urushiwara et al. |
| 4,987,520 | A | | 1/1991 | Rots |
| 5,016,463 | A | * | 5/1991 | Johansson et al. ..... 72/354.8 |
| 5,397,023 | A | | 3/1995 | Toczek et al. |
| 5,570,803 | A | | 11/1996 | Farwell |
| 5,598,734 | A | * | 2/1997 | Forrest et al. ..... 72/348 |
| 5,845,811 | A | | 12/1998 | Shervington et al. |
| 6,786,507 | B2 | | 9/2004 | Dolling et al. |
| 7,234,481 | B2 | * | 6/2007 | Henderson et al. ..... 137/68.26 |
| 7,552,612 | B2 | * | 6/2009 | Heinicke ..... 72/348 |
| 2005/0155991 | A1 | | 7/2005 | Jackman |

* cited by examiner

DIE COMPONENTS FOR MAKING PRESSURE RELIEF DEVICES

RELATED APPLICATIONS

This application is a division of U.S. patent application Ser. No. 10/924,486, filed Aug. 24, 2004 now U.S. Pat. No. 7,222,757, and allowed Feb. 26, 2007.

FIELD OF INVENTION

This invention relates to pressure release devices for internally pressurized fluid containers and aerosol cans having such pressure relief devices.

BACKGROUND OF THE INVENTION

Pressurized fluid containers are in widespread use for packaging and dispensing a variety of fluid products, including liquids, gases, solids and combinations thereof. Under normal operating conditions, such containers perform entirely satisfactorily. However, in the event that the contents of such containers become over-pressurized, either because of improper use, exposure to heat or for any other reason, then a violent rupture may occur. The art has provided a variety of pressure relief devices for aerosol cans to prevent explosion of the pressurized can. Many of these pressure relief devices are in the bottom of the can, while some are in the sidewall or top. The pressure relief devices that have been proposed for the bottom have one or more of three basic structures that function to relieve pressure. The first type has a valve or stopper which opens or pops when a selected pressure level is reached within the can. A second type of pressure relief device has a scored line or lines in the bottom creating one or more regions in which the thickness of the can bottom is reduced. When the pressure in the can reaches a certain level the bottom ruptures along this region. A third category of pressure relief devices provides one or more concave regions on the can bottom. This region everts when the pressure in the can reaches a selected level thereby increasing the volume of the can and reducing the pressure. Examples of some of these previously developed pressure release devices are disclosed in U.S. Pat. No. 2,795,350 (Lapin); U.S. Pat. No. 3,292,826 (Abplanalp); U.S. Pat. No. 3,512,685 (Ewald); U.S. Pat. No. 3,622,051 (Benson); U.S. Pat. No. 3,724,727 (Zundel); U.S. Pat. No. 3,786,967 (Giocomo); U.S. Pat. No. 3,815,534 (Kneusel); U.S. Pat. No. 3,826,412 (Kneusel); U.S. Pat. No. 3,831,822 (Zundel); U.S. Pat. No. 4,003,505 (Hardt); U.S. Pat. No. 4,347,942 (Jernberg et al.); U.S. Pat. No. 4,416,388 (Mulawski); and U.S. Pat. No. 4,433,791 (Mulawski). In these prior art devices, scored or coined lines of reduced material thickness are caused to fracture in response to an over-pressurization of the container contents, thereby creating vent openings. Some pressurized cans have bottoms which have both scored regions and concave regions. Other types of pressure relief devices are disclosed in U.S. Pat. No. 2,951,614 (Greene); U.S. Pat. No. 3,356,257 (Eimer); U.S. Pat. No. 3,515,308 (Hayes); U.S. Pat. No. 3,759,414 (Beard) and U.S. Pat. No. 4,158,422 (Witten et al.).

One problem with cans having score lines in the bottom is that such devices have been difficult and expensive to manufacture in the large quantities needed to fill existing commercial demands. The problem stems from the need to consistently maintain a prescribed coin depth along the line or lines surrounding either a pressure release tab or a rim of the container. This is particularly true of the device disclosed in Mulawski U.S. Pat. No. 4,433,791. When manufacturing the device from sheet steel having a thickness of 0.015", the coined depth must be maintained within an extremely narrow range of between about 0.0015" and 0.0025" in order to insure that pressure is released within a range of between about 210 to 250 psi. A shallower coin depth will result in an unacceptably high pressure release, thereby presenting a risk that the container will fail in an unpredictable manner. On the other hand, a deeper coin depth may produce a prematurely low pressure release, and prompt the development of micro cracks in the remaining relatively thin membrane at the base of the coined line. These micro cracks may not always be detectable at the time of manufacture. They may occur later after the container has been filled with a pressurized product, thereby resulting in leakage and potentially costly losses. Thus, the manufacturing process must be carefully monitored with particular attention to timely equipment adjustments to compensate for tool wear, and, when appropriate, to replace worn tools. This requires frequent product sampling and testing, all of which significantly increases manufacturing costs.

Another problem that is encountered in the manufacture of pressure relief devices results from the fact that the sheet metal from which the device is formed frequently varies in thickness by a few thousandths of an inch. If the region being coined is thinner than specified, then the web at the coined region likely will be thinner than expected. A difference of only a few thousandths can result in premature rupture of the coined region.

Because of the many manufacturing problems that are encountered in making pressure relief devices having coined regions, those skilled in the art have attempted to develop pressure relief devices that do not have any coined regions. Indeed, Mulawski in U.S. Pat. No. 4,580,690 teaches away from the use of coined regions in a pressure relief device, advocating a highly effective pressure release device which is entirely free of scored or coined lines. Such a device is said to thereby obviate many of the above-described production problems associated with the prior art devices having coined regions.

Consequently, there is a need for a pressure relief device having a coined section that can be mass produced in a manner that will overcome the problems associated with the manufacture of the coined pressure relief devices of the prior art. This device should hold pressures of at least 200 psi before venting and preferably hold pressures of at least 300 psi before venting.

SUMMARY OF THE INVENTION

We provide a pressure relief device for venting an internally pressurized container and an aerosol can having a can bottom containing this pressure relief device. The pressure relief device has three sections, a concave annular outer area, a circular central area and an annular intermediate area connecting the concave annular area to the circular area. The three sections are formed from a continuous sheet. The central area has a center point and an arc shaped score line extending through 132° to 138°, preferably about 135°, about an arc center. The arc center is offset from the center point of the circular area by a distance of from 0.290 plus or minus 0.002 inches. The score line has a depth of from 0.010 to 0.012 inches and is trapezoidal in cross section with a taper of about 30°. The width at the base is about 0.34 inches. The intermediate area meets the circular area at an angle greater than 90° and the intermediate area meets the concave annular outer area at an angle greater than 90°.

We further provide a compound die for making the pressure relief device. While a compound die is the preferred tooling apparatus, other devices, such as progressive dies, would also be suitable. The die has a male portion having a concave annular outer area region, a circular central area having a recess, and an annular intermediate area connecting the concave annular area to the circular area such that the intermediate area meets the circular area at an angle greater than 90° and the intermediate area meets the concave annular outer area at an angle greater than 90°. An insert is removably inserted into the recess in the male portion. That insert has a circular top surface having a center point and an arc shaped projection extending through 132° to 138° about an arc center. The arc center is offset from the center point of the circular area by a distance of from 0.290 plus or minus 0.002 inches. The projection has a height of from 0.022 to 0.024 inches and a width of 0.034 inches at the maximum.

Other objects and advantages of our pressure relief device, aerosol can and die will become apparent from a description of certain present preferred embodiments thereof which are shown in the drawings.

DETAILED DESCRIPTION OF THE PREFERRED EMBODIMENTS

Figure 1:
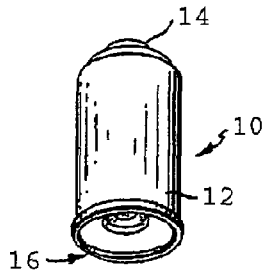
FIG. 1 is a bottom perspective view of a container including a pressure release device in accordance with the present invention.

A container 10 of the type conventionally employed to package and dispense pressurized fluid products is shown in FIG. 1. The container has a cylindrical side wall 12 with a reduced diameter neck 14 at one end to accommodate acceptance of a conventional cap, dispensing valve or the like (not shown). The opposite end or bottom of the container is closed by a pressure relief device 16 in accordance with the present invention.

Figure 2:
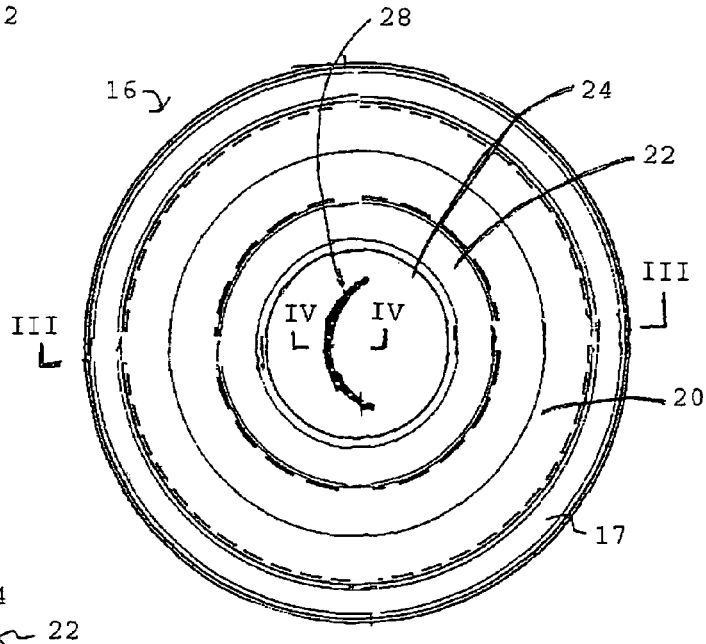
FIG. 2 is a plan view of the bottom of the container shown in FIG. 1.
Figure 3:
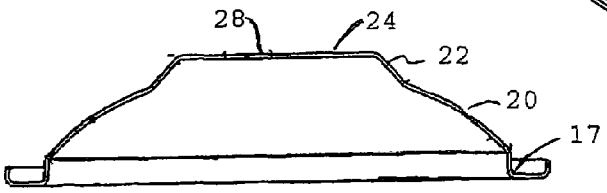
FIG. 3 is a sectional view taken along line III-III of FIG. 2.
Figure 4:
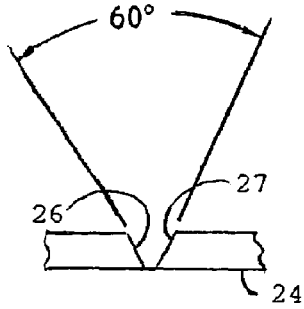
FIG. 4 is a sectional view taken along line IV-IV of FIG. 2.
Figure 5:
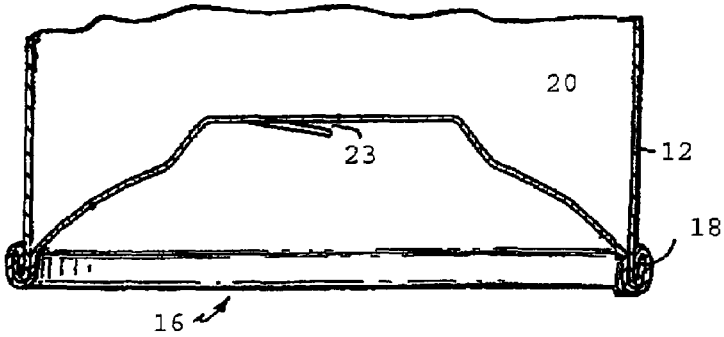
FIG. 5 is a sectional view similar to FIG. 3 after the pressure device has released.
Figure 6:
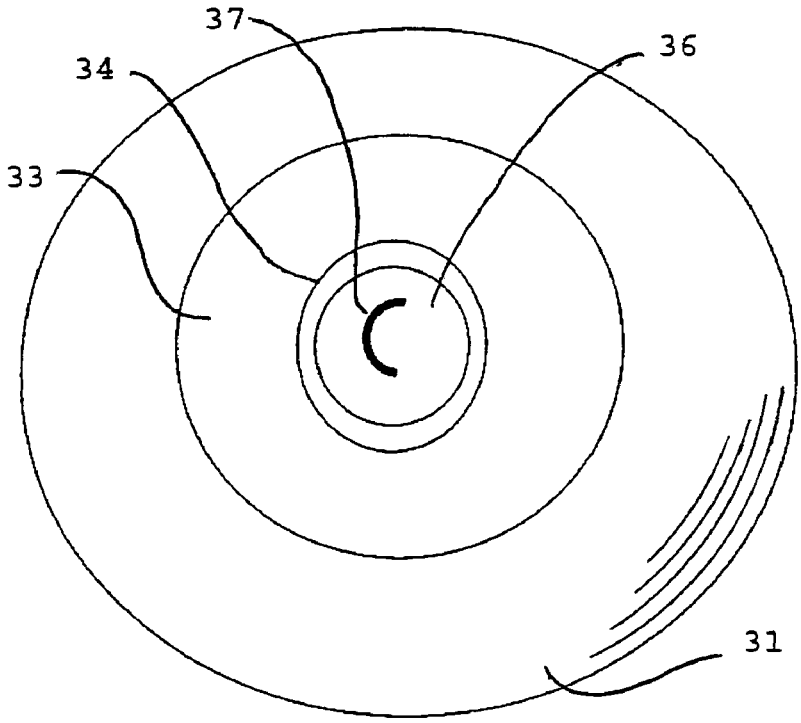
FIG. 6 is a perspective view of a male portion of a present preferred die used to make the pressure release device of FIGS. 1, 2 and 3.
Figure 7:
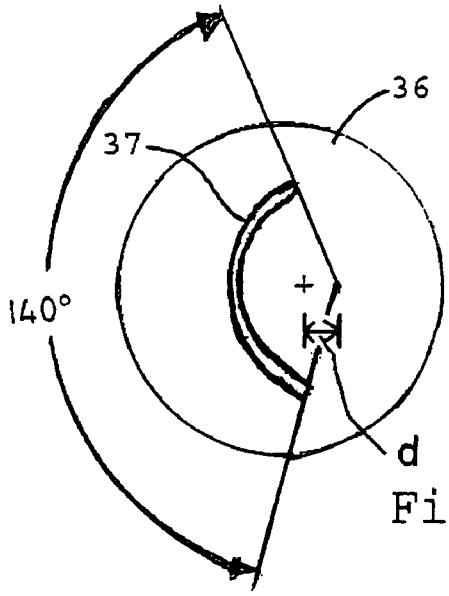
FIG. 7 is a top plan view of the insert in the male portion of the die of FIG. 6.
Figure 8:
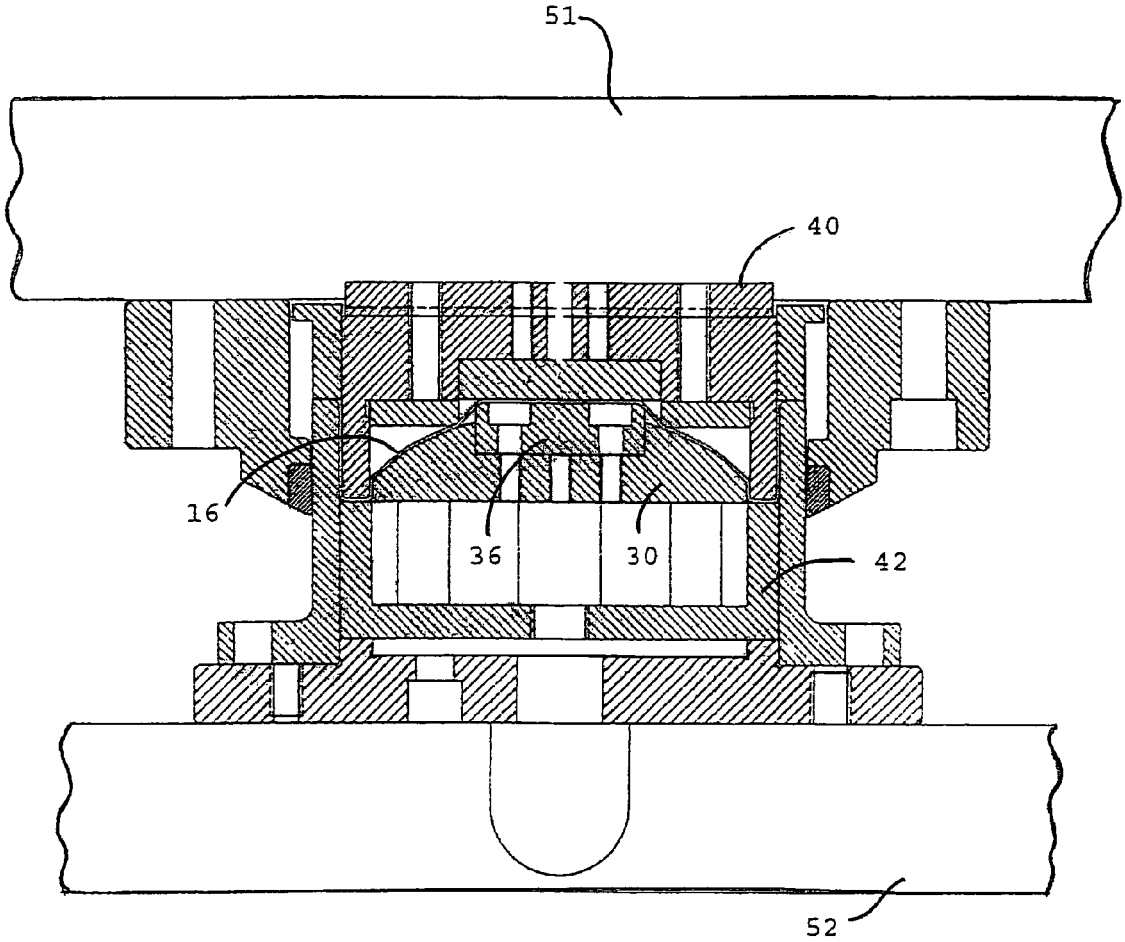
FIG. 8 is a sectional view of a compound die apparatus containing the male portion shown in FIGS. 6 and 7.

A present preferred embodiment of the pressure relief device 16 shown in FIGS. 2 through 5 has and annular lip 17 adapted to be connected to the container side wall 12 by any conventional means, such as for example the double seam connection 18 commonly used in the art. The pressure relief device 16 has a concave annular outer area 20 bordered by lip 17. In one present preferred embodiment the outer annular area has a maximum diameter of about 3 inches and a height of about 0.765 inches. Annular outer area 20 is integrally joined by means of an annular intermediate area 22 to an inwardly protruding circular central area 24. The annular intermediate area has a preferred maximum diameter of 2.375 inches and the central area has a preferred diameter of 1.25 inches. The pressure relief device can be used on any type of pressurized can known in the art. Typically, these cans will have a diameter between about 1.375 inches and 8.25 inches. The diameters of the annular outer area, annular intermediate area and central area for cans larger or smaller than the preferred embodiment would have the same or similar dimensional relationships as these areas have in the preferred embodiment. The intermediate area meets the circular area at an angle greater than 90°, preferably about 133°. The intermediate area meets the concave annular outer area at an angle greater than 90°, preferably about 142°. The device 16 is drawn from a blank of electrolytic tin coated, single reduced, sheet steel or other equivalent sheet steel product. These blanks have an actual thickness of from 0.0228 inches to 0.0252 inches. If desired, a 0.026 inch blank could be used. A present preferred die set 30 and 40 used to make the pressure relief device is shown in FIGS. 6 through 8 and will be described in detail below. The thickness of the metal should not change significantly during forming. Consequently, the thickness of the pressure relief device should be about 0.024 inches. A score line is provided in the circular central area 24. The central area 24 has a center point and an arc shaped score line 28 extending through 132° to 138°, preferably 135° about an arc center. Corresponding points on the insert to the male die portion 30 are shown by the plus sign and dot in FIG. 7. The arc center is offset from the center point of the circular area by a distance d of from 0.290, plus or minus 0.002, inches. Referring now to FIGS. 2 and 4, the score line 28 should have a depth of from 0.010 to 0.012 inches. However, the coined area may have a coin depth of 0.0108 to 0.014 inches. The score line should have a width of 0.034 inches at the base and 0.010 to 0.012 inches at the top. As can be seen in FIG. 4, the base is coplanar with the surface of the pressure relief device. We prefer to provide angled side walls 26, 27 in the score line such that a first plane passing over a surface of one side wall 26 and a second plane passing of over a surface of the second side wall 27 will form a trapezoidal configuration and intersect at an angle of 30° as shown in FIG. 4. Consequently, the angle between intersecting planes on the surfaces of side walls 26 and 27 would be 60°, giving each side wall a 30° taper. When the can is over pressurized at about 340 psi to 360 psi the bottom will rupture along the score line as shown in FIG. 5 allowing the can to vent through opening 23.

We tested several sample cans having the pressure relief device shown in FIGS. 2 through 5 to determine the pressure at which venting occurs. The device was made using the compound die illustrated in FIGS. 6 through 8. We also tested comparably sized cans having a concave three inch bottom or a pressure release bottom of the type disclosed in U.S. Pat. No. 4,580,690 or U.S. Pat. No. 4,513,874. The can of the '690 patent has a bottom with an outer annular area connected to a central circular area by an intermediate area similar to the present invention. But, there is no coined region and the bottom is made from 0.015" tinplate steel. The can of the '874 patent has a concave bottom and a generally convex tab member at its center. The tab member is partially circumscribed by a line of reduce material thickness. The cans were pressurized until the bottom of the can vented and that pressure was recorded. The cans made in accordance with the '874 patent first reversed curvature in one or more locations and then vented. For that can we recorded the pressures at which reversal and venting occurred. We also recorded the coin depth of those cans tested that had coined regions. The results of that test are shown in Table 1. The can having a bottom as set forth in FIGS. 2 through 5 is identified as DROC.

TABLE 1

| Sample | Concave VENT (psi) | '690' REV/VENT (psi) | DROC VENT (psi) | DROC COIN DEPTH (inches) | '874 VENT (psi) | '874 COIN DEPTH (inches) |
|---|---|---|---|---|---|---|
| 1 | 320 | 388/426 | 348 | 0.0048 | 409 | 0.0042 |
| 2 | 325 | 380/435 | 353 | 0.0050 | 471 | 0.0044 |
| 3 | 328 | 393/436 | 351 | 0.0049 | 451 | 0.0043 |
| 4 | 330 | 401/412 | 351 | 0.0051 | 463 | 0.0043 |
| 5 | 320 | 425/449 | 342 | 0.0052 | 444 | 0.0044 |
| 6 | 330 | 419/434 | 350 | 0.0051 | 456 | 0.0045 |
| 7 | 315 | 456/458 | 355 | 0.0053 | 464 | 0.0043 |
| 8 | 330 | 413/425 | 360 | 0.0052 | 467 | 0.0043 |
| 9 | 340 | 416/425 | 345 | 0.0051 | 465 | 0.0044 |
| 10 | 337 | 409/436 | 359 | 0.0051 | 470 | 0.0044 |
| 11 | 330 | 432/453 | 349 | 0.0051 | 450 | 0.0042 |
| 12 | 334 | 446/454 | 341 | 0.0054 | 457 | 0.0041 |
| Range | 25 | 24/46 | 19 | 0.0006 | 62 | 0.0004 |

From Table 1 we can see that cans having the pressure relief device of the present invention will vent at pressures from 341 psi to 360 psi, a range of only 19. The ranges for all other types of cans at which venting occurs is much wider. Moreover, this narrow range occurred when the coin depth varied from 0.0048" to 0.0054", a difference of only 0.0006". In contrast, cans having the pressure relief bottom disclosed in the '874 patent vented over a wider range of pressures, 409 psi to 471 psi even though coining depths were within a narrower range. This data demonstrates that a can made in accordance with the present invention is much more reliable than aerosol cans having pressure relief devices of the prior art. We attribute the improved performance of the DROC cans made in accordance with the present invention to the combination on of the thickness and curvature of the pressure relief device coupled with the position of the score line. While one might expect better performance when the score line is centered about the center of the circular area, our tests showed that just the opposite was true. Better performance is obtained when the score line is offset by about 0.290 inches from the center point of the circular central area.

To further test the integrity of the present design we evaluated a can made in accordance with the present invention but without the coined section. This test simulates a condition in which the coined section fails to operate to vent and the situation in which the coined section is not applied because of a defect in the die or improper operation of the press. Table 2 presents the results of that test. As the data indicates, the can without the coined section first reversed its curvature and then fractured allowing the can to vent. The table records the pressure at which fracture and venting occurred. For purposes of comparison Table 2 also includes the performance of cans having a bottom as disclosed in U.S. Pat. No. 4,580,690, which data also appears in Table 1.

TABLE 2

| Sample | DROC VENT (psi) | Plain DROC REV/VENT (psi) | '690' REV/VENT (psi) |
|---|---|---|---|
| 1 | 348 | 482/468 | 388/426 |
| 2 | 353 | 503/466 | 380/435 |
| 3 | 351 | 507/458 | 393/436 |
| 4 | 351 | 468/471 | 401/412 |
| 5 | 342 | 495/460 | 425/449 |
| 6 | 350 | 493/462 | 419/434 |
| 7 | 355 | 481/462 | 456/458 |
| 8 | 360 | 488/455 | 413/425 |
| 9 | 345 | 458/455 | 416/425 |

TABLE 2-continued

| Sample | DROC VENT (psi) | Plain DROC REV/VENT (psi) | '690' REV/VENT (psi) |
|---|---|---|---|
| 10 | 359 | 462/462 | 409/436 |
| 11 | 349 | 456/456 | 432/453 |
| 12 | 341 | 493/453 | 446/454 |
| Average | 350 | 478/461 | 415/437 |

The data in Table 2 shows that a can made in accordance with the present invention has a significant margin of integrity should the can not vent. Moreover, the can is able to withstand pressures significantly higher than the pressures that a can of the '690 patent can withstand. We attribute this performance to the thickness and curvature of the pressure release device.

The data in Table 1 shows that the coin depth varied by only 0.0006 inches among the DROC cans tested and that the variation had little effect upon performance. We are able to achieve such a small variance through the use of the die set shown in FIGS. 6 through 8. The die component forming the male portion 30 of the die set has a concave annular outer area 31. A circular central area 34 having a recess 35 rests on an annular intermediate portion 33 that connects the concave annular outer area 31 to the circular area 34. An insert 36 is removably inserted into the recess 35. That insert 36 has a circular top surface having a center point and an arc shaped projection 37 extending through 135° about an arc center. The arc center is offset from the center point of the circular area by a distance "d" of 0.290 inches. The trapezoidal projection has a height of from 0.022 to 0.0240 inches. That height will correspond to a coin depth of 0.0048 inches.

Turning to FIG. 8 a present preferred compound die set is shown in section between platens 51, 52 of a press. A blank is held between first die portion 40 and second die portion 42. Initially, the male portion 30 with insert 36 is within the second die portion 42. Then the male portion 30 is advanced to the position shown in FIG. 8 to form the pressure relief device 16. The die will wear during use with the insert being subjected to more wear than other portions of the die. Wear of the insert will change the depth of the score line. Consequently, the insert must be replaced more frequently than other portions of the die. Replacing the insert is much less expensive than the cost to replace the entire male portion 30 or a male portion in which the portion of the die defined by the insert is integral with the male portion and is not removable. Therefore, the present die set is superior to other metal forming dies known in the art. While a compound die is the preferred tooling apparatus, other devices, such as progressive dies, would also be suitable. The male portion of these other devices would be similar to the male portion shown in the drawings.

Although we have shown and described certain present preferred embodiments of our pressure relief device, aerosol can and die, it should be distinctly understood that our invention is not limited thereto, but may be variously embodied within the scope of the following claims.

We claim:

1. A die component comprising:

a male portion having a concave annular outer area region, a circular central area having a recess, and an annular intermediate area connecting the concave annular area to the circular area such that the intermediate area meets the circular area at an angle greater than 90° and the intermediate area meets the concave annular outer area at an angle greater than 90°; and an insert removably inserted into the recess in the male portion, that insert having a circular top surface having a center point and an arc shaped projection extending through 132° to 138° about an arc center, the arc center offset from the center point of the circular area by a distance of from 0.288 to 0.292 inches, the projection having a height of from 0.022 to 0.024 inches, a first width of at least 0.010 to 0.012 inches and a second width of 0.034 inches.

2. The die component of claim 1 wherein the arc-shaped projection extends though an arc of 135°.

3. The die component of claim 1 wherein the arc center is offset from the center point by a distance of 0.290 inches.

4. The die component of claim 1 also comprising other die components joined together with the male portion and the insert in a manner to form a compound die.

5. The die component of claim 3 also comprising a second die component having a cavity sized and configured to receive the male portion, the second die component positioned relative to the male portion so that the male portion can move within the cavity.

* * * * *